United States Patent [19]

Offenstadt et al.

[11] 4,398,509

[45] Aug. 16, 1983

[54] TWO-STROKE MOTOR

[75] Inventors: Eric Offenstadt, Pontoise; Bernard Houzé, Neuilly, both of France

[73] Assignee: Sercati, Paris, France

[21] Appl. No.: 211,973

[22] Filed: Dec. 1, 1980

[30] Foreign Application Priority Data

Dec. 3, 1979 [FR] France ..... 79 29648

[51] Int. Cl.[3] ..... F02B 1/08; F02B 33/04

[52] U.S. Cl. ..... 123/73 CC; 123/73 AF; 123/432; 123/69 R

[58] Field of Search ..... 123/432, 433, 73 CC, 123/73 AF, 73 AD, 69 R

[56] References Cited

U.S. PATENT DOCUMENTS

| | | | |
|---|---|---|---|
| 4,191,141 | 3/1980 | Franke | 123/73 CC |
| 4,248,185 | 2/1981 | Jaulmes | 123/73 CC |
| 4,276,858 | 7/1981 | Jaulmes | 123/73 CC |
| 4,289,094 | 9/1981 | Tanahashi | 123/73 CC |

FOREIGN PATENT DOCUMENTS

| | | | |
|---|---|---|---|
| 678269 | 7/1939 | Fed. Rep. of Germany | 123/73 AD |
| 911078 | 5/1954 | Fed. Rep. of Germany | 123/73 AF |
| 52-50416 | 4/1977 | Japan | 123/73 AD |
| 52-50417 | 4/1977 | Japan | 123/73 AD |
| 54-145806 | 11/1979 | Japan | 123/73 CC |

*Primary Examiner*—Wendell E. Burns

*Attorney, Agent, or Firm*—James Creighton Wray

[57] ABSTRACT

This motor is of the type comprising a case having a cylindrical upper part in which a piston is slidably mounted and a lower part in which a crankshaft connected to the piston is disposed. The case further comprises on one hand, an intake port and an exhaust port which open onto the upper part of the case, the input port being disposed below the exhaust port, and, on the other hand, at least one transfer conduit interconnecting the two parts of the case.

The motor comprises a supply circuit for non-carburetted fresh gases which is connected to at least one port of the upper part of the case, the upper edge of this at least one port being disposed below the upper edge of the exhaust port.

The motor is applicable in particular to motorcycles.

11 Claims, 9 Drawing Figures

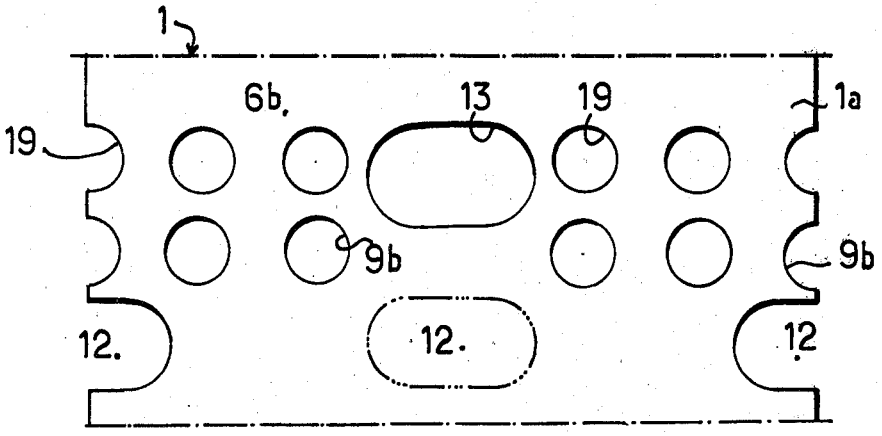
FIG.2
FIG.3
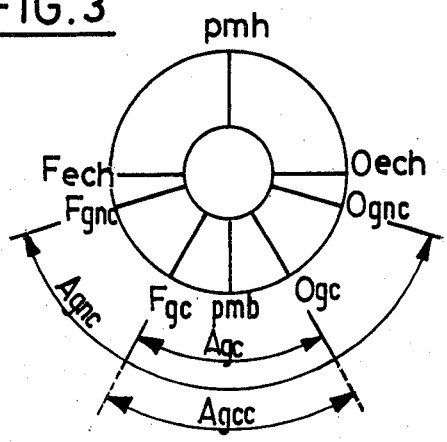
FIG.8
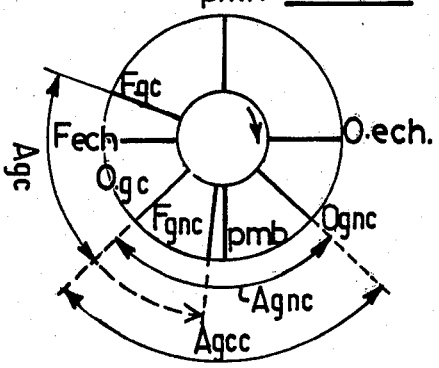
FIG.4
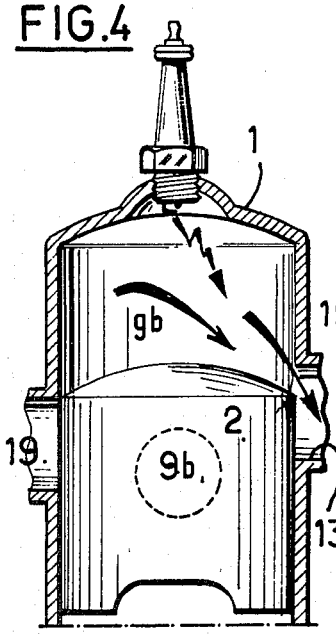
FIG.5
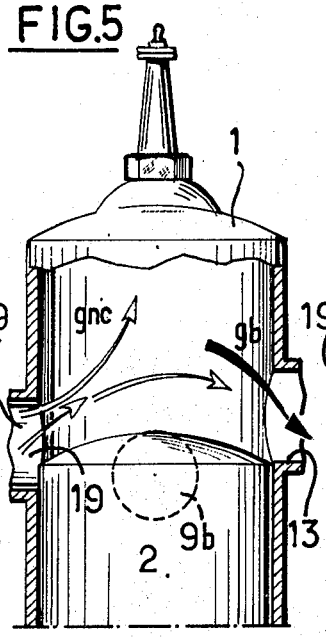
FIG.6
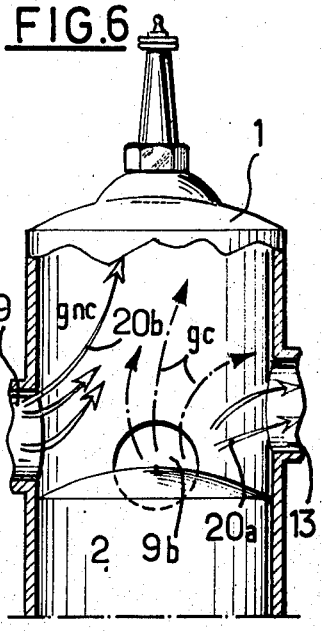

TWO-STROKE MOTOR

The present invention relates to two-stroke motors in particular for motorcycles, i.e. motors comprising case which includes a cylindrical upper part in which a piston is slidably mounted and a lower part in which there is disposed a crankshaft connected to said piston, said case further comprising, on one hand, an intake port and an exhaust port which open onto said upper part, the intake port being disposed below the exhaust port and, on the other hand, at least one transfer conduit interconnecting the two parts of the case.

In motors of this known type, it is the fresh carburetted gases admitted into the lower part of the case which, when the piston uncovers the transfer ports expel, the burnt gases, which is called scavenging.

Now, this direct scavenging mixes the fresh carburetted gases more or less with the burnt gases and this results in a loss of carburetted gases through the exhaust and consequently an excessive consumption of fuel. In known motors, it has been attempted to reduce its consumption by reducing the transfer time in such manner that the fresh gases do not have time enough to escape through the exhaust. In this case however, a lot of burnt gases remain in the cylinder and result in low efficiency.

Further, the lubrication of the known motors was effected by a mixture of lubricant with the fresh carburetted gases so that the more of these gases admitted, the greater was the amount of oil burnt in the exhaust and this resulted in a polluting smoke.

Consequently, an object of the invention is to avoid, on one hand, the excessive consumption of fuel due to the direct scavenging and, on the other hand, the pollution due to lubrication by means of the carburetted gases.

According to the invention, there is provided a motor of the aforementioned type which comprises a circuit for fresh non-carburetted gases connected to at least one port of the upper part of the case, the upper edge of said port being disposed below the upper edge of the exhaust port.

With this arrangement, a little after the piston has started to uncover in its downward stroke the exhaust port and consequently the burnt gases have started to escape, the same piston uncovers the intake port of the fresh non-carburetted gases (said fresh gases comprising air in which advantageously and in accordance with the invention vaporized lubricating oil has been introduced) so as to permit a complete scavenging of the burnt gases before the usual mixture of carburetted gases is introduced.

In certain particular embodiments of the invention, it may be advantageously arranged that the intake port be employed as the intake port of the carburetted gases and that the port of the non-carburetted fresh gases supply circuit be disposed above the port through which the transfer conduit communicates with the upper part of the case.

In this way, the carburetted gases are introduced only after the non-carburetted gases have scavenged the burnt gases, so that any loss of carburetted gases entering these burnt gases is avoided.

In other particular embodiments of the invention, it may also be advantageously arranged that the intake port be employed as the intake port of the non-carburetted fresh gases which communicates, by way of the transfer conduit, with the port of the upper wall of the case and that there be provided in the same wall, above said port, an intake port for carburetted gases connected to a carburetted gas supply circuit comprising valve means.

Thus, notwithstanding the fact that this carburetted gas intake port is disposed above the non-carburetted gas intake port, the valve means can only be opened after the non-carburetted gases have scavenged the burnt gases, which consequently affords the same advantage as in the preceding case. However, this arrangement also allows very advantageously a regulation at will of the instant of this opening of the admission of the carburetted gases and consequently in particular an adaptation to the running speed of the motor so that maximum power with low consumption is achieved.

In both cases, there is provided a gas supply circuit (non-carburetted fresh gas in the first case and carburetted gas in the second case) which is independent of the transfer conduit which is employed for the introduction of the other gases. Preferably, it may be arranged that this gas supply circuit comprise pressurizing means the output side of which is connected to the intake port of the upper part of the case.

It must be stressed that the general arrangement provided by the invention permits a saving in fuel, since it is no longer the carburetted mixture which scavenges the exhaust gases and there is consequently no longer any risk of loss of fuel through the exhaust.

Further, the pressure of the non-carburetted fresh gases in the cylinder permits a more rapid discharge of the burnt gases, since the scavenging thereof may start sooner in the cycle with no fear of loss of fuel. Consequently, this permits a reduction in the exhaust time which, in a two-stroke motor, increases the driving torque value and the efficiency.

Moreover, the double intake of air and carburetted gases permits in all admitting into the combustion chamber a larger volume of gaseous mixture and thus increases the power.

The fact that the exhaust of the burnt gases is disassociated from the intake of the carburetted mixture enables the motor to be regulated in such manner that, even when operating at low running speed, the carburetted gases cannot pass through the exhaust, whereas in a conventional two-stroke motor, it is accepted that at very low running speed, more than 50% of the carburetted gases are lost. This economy should afford an engine according to the invention a gain in flexibility, and consequently power, of the order of 50% at low running speed.

In all, for a given power obtained, a two-stroke motor according to the invention should result in a fuel economy of 30 to 50% with respect to a conventional two-stroke motor and 10 to 30% with respect to a four-stroke motor.

Further features and advantages of the invention will be apparent from the ensuing description given mainly by way of examples with reference to the accompanying drawings in which:

FIG. 2 is a developed view of the wall of the case of this motor;

FIG. 3 is a diagram of the cycle of operation of this motor;

FIGS. 4 to 6 illustrate various stages of this cycle of operation;

FIG. 8 is a diagram of the cycle of operation of the second embodiment;

Figure 1:
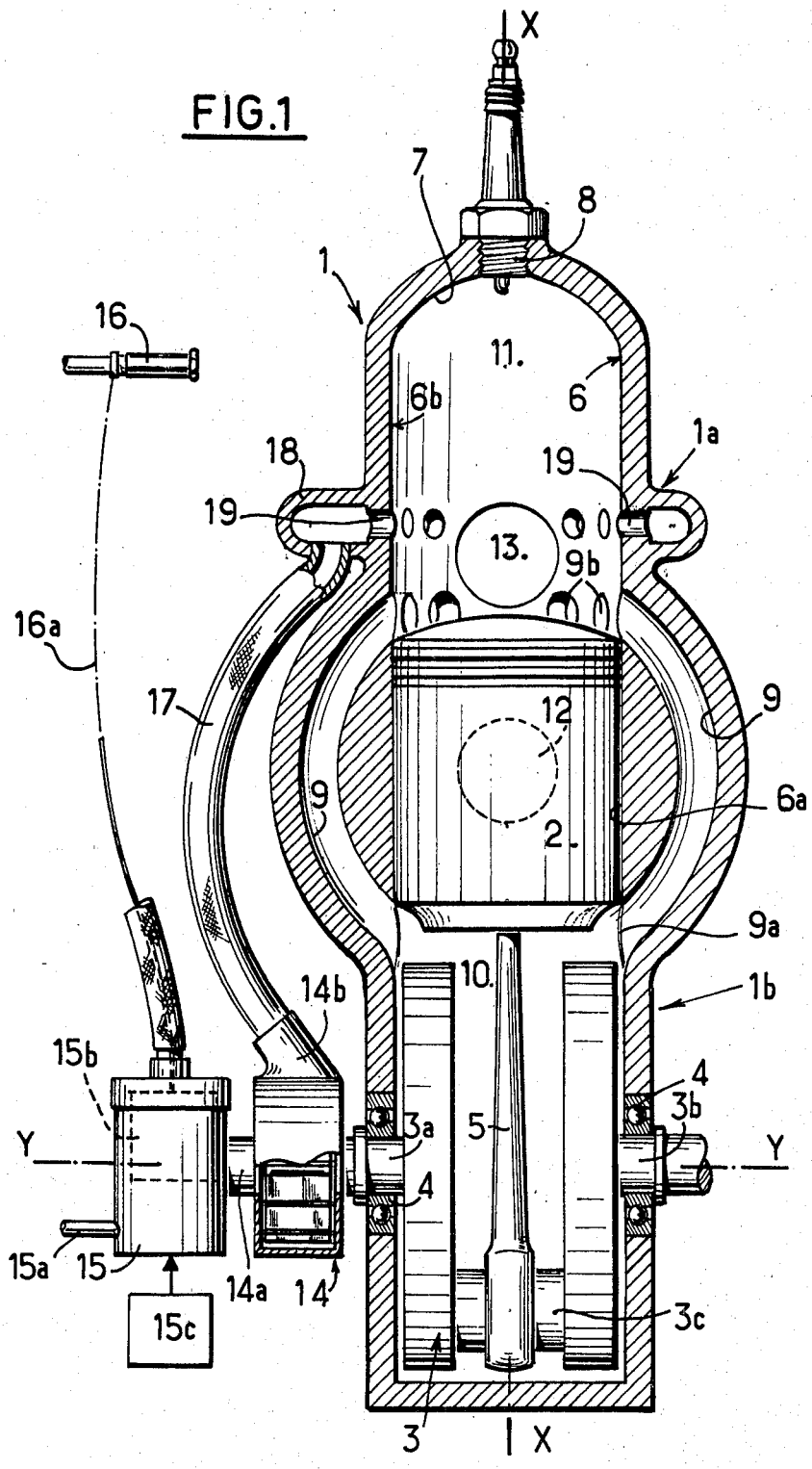
FIG. 1 is an elevational and sectional view of a two-stroke motor, in particular for motorcycles, according to a first embodiment of the invention.

The motor illustrated in FIGS. 1 to 6 is a two-stroke motor comprising a case 1 having a cylindrical upper part 1*a* of vertical axis X—X in which a piston 2 is slidably mounted and a lower part 1*b* disposed below the upper part and in which there is disposed a crankshaft 3, the two shaft sections 3*a* and 3*b* of which are rotatably mounted in bearings 4 in opposite walls of the lower part of the crankcase. A crankpin 3*c* of this crankshaft receives an end of a piston rod 5 which is connected at its other end to the inside of the piston 2.

It is more precisely the inner surface of the upper part 1*a* of the case which is of cylindrical shape, this surface 6 comprising a lower surface portion 6*a*, whose vertical extent approximately corresponds to that of the skirt of the piston 2, and an upper surface portion 6*b* disposed above the surface portion 6*a* and terminating in its upper part in a hollow end wall 7 in which a sparkplug 8 is disposed on the axis X—X. The vertical extent of this upper surface 6*b* is at least equal to that of the skirt of the piston.

The lower surface 6*a* is disposed in such manner with respect to the axis Y—Y of the shaft sections 3*a* and 3*b* of the crankshaft that the piston 2 is disposed as shown in FIG. 1 exactly in facing relation to this surface 6*a* when it is at bottom dead centre of the cycle, i.e. when the crankpin of the crankshaft is in the lowest position in its circular motion about the axis Y—Y.

In a vertical extent exceeding that of the surface 6*a*, the wall of the case 1 is thickened and has in its thickened part transfer conduits 9 which put the lower ports 9*a* which open, below the surface 6*a*, onto a cavity 10 formed in the lower part of the case or case base 1*b* with upper ports 9*b* which open, immediately above the surface 6*a*, onto an upper cavity 11 defined by the surface 6*b* and the end wall 7.

Also provided are an intake port 12 for the carburetted gases (connected in the conventional manner to a carburetter, not shown) and an exhaust port 13 for the burnt gases (also connected in the conventional manner to an exhaust), these two ports being disposed roughly in the middle of the surface 6*a* and above the transfer ports 9*b* respectively, these intake and exhaust ports constituting orifices through which intake and exhaust pipes (not shown) communicate with the interior of the case.

As shown in FIGS. 1 and 2, there are provided a single exhaust port 13, and consequently a single exhaust pipe, this port having a relatively large section, and either one intake port 12 in which case the latter is disposed at 180° to the exhaust port 13, or two intake ports, the second of which is then disposed below the exhaust port, this or these intake ports having a section of the same order of magnitude as that of the exhaust port. As concerns the transfer ports 9*b*, a larger number thereof have been provided, for example five, and they are evenly spaced apart on the periphery of the case, (there are of course as many transfer conduits 9 and lower parts 9*a*) outside the zone in which the exhaust port 13 is located bearing in mind that, as shown in FIG. 1, the lower edge of this exhaust port is located at a point which is intermediate the height of these ports 9*b*.

The arrangement described herein before corresponds to that of known two-stroke motors.

This arrangement is completed by a complementary supply circuit 14 which is disposed on one side of and outside the case 1. This circuit comprises a compressor 14 which is mounted on the end of one 3*a* of the shaft sections of the crankshaft. The input side 14 of this compressor is connected to control means 15 which comprise a non-carburetted fresh gas inlet 15*a* and a flap, slide valve or butterfly valve 15*b*, which is actuated by the accelerator or fuel supply control member 16 associated with this motor. This control means 15 may for example be formed by a carburetter in which the petrol or gasoline input pipe has been closed and the float-chamber eliminated. A source of vaporized oil 15*c* is also connected to this control means 15. As concerns the output end 14*b* of the compressor 14, it is connected by piping 17 to a distribution ring or manifold 8 arranged in the wall of the case, complementary supply ports 19 putting this manifold in communication with the cavity 11.

As shown in FIGS. 1 and 2, the number of these ports 19 is the same as the number of transfer ports 9*b*. They have substantially the same section and are arranged on the periphery of the case in the same way as the ports 9*b*. In the direction of the axis X—X, there are disposed at a level located substantially below the upper edge of the exhaust port 13.

This complementary part of the arrangement permits, when the fuel supply control member 16 is actuated for opening the carburetter (or by way of modification the injection system) simultaneously actuating through the connection 16*a* the butterfly valve (or by way of modification the plug) 15*b* of the control means 15, the actuation of the butterfly valve allowing the supply of non-carburetted gases, in fact outside air, this air being drawn in by the turbine or compressor 14 and sent by the latter into the upper cavity 11 of the case through the pipe 17 and the ports 19.

The motor just described operates in the following general manner:

FIG. 3 approximately illustrates the cycle of this motor by indicating at what instant in the cycle, or more precisely at what angle the crankpin of the crankshaft is relative to an initial instant corresponding to its upper dead centre, i.e. its upper position on the axis X—X. In FIG. 3, the double arrow Agc indicates the intake stage of the carburetted gases according to the invention, the double arrow Agcc the intake stage of the carburetted gases in a conventional motor and the double arrow Agnc the intake stage of the non-carburetted gases.

In the upper dead centre position, the piston is in its upper position and closes all the exhaust, transfer and complementary intake ports 13, 9*b* and 19. On the other hand, the intake port 12 of the carburetted gases is uncovered by the piston and consequently communicates with the cavity 10 of the lower case which is thus filled with carburetted gases.

At about 90° of the cycle (Oech), the piston starts to uncover the exhaust port 13 without, however, uncovering the complementary intake ports 19 (position shown diagrammatically in FIG. 4). During this stage, the burnt gases Gb, produced in the course of the preceding cycle owing to the explosion caused by the sparkplug 8 (which explosion causes an expansion displacing the piston), start to escape by way of the port 13.

At about 105° of the cycle (Ognc), the piston also starts to uncover the complementary intake ports 19 which allow the admission of non-carburetted fresh gases Gnc coming from the turbine 14, while the transfer ports 9b are not yet uncovered (position shown diagrammatically by FIG. 5). During this stage, the non-carburetted fresh gases, or air, have a tendency to occupy the cavity 11 and thus effect a scavenging of the remaining burnt gases which travel in the direction of the exhaust 13.

At 160° of the cycle (Ogc), the piston starts to uncover the transfer ports 9b and thus allows the entry of the carburetted gases Gc in the cavity 11. In this stage (shown diagrammatically in FIG. 6), almost all the burnt gases have passed through the exhaust port 13 and there remains a buffer or cushion of non-carburetted gases, or air 20a, in the vicinity of this exhaust port. The carburetted gases enter the cavity 11 from the cavity 12 and, under the effect of the compression owing to the descent of the piston, occupy practically the whole of the volume of this cavity 11 except for the aforementioned air buffer or cushion 20a and another air buffer or cushion 20b in the vicinity of the complementary intake ports 19.

At 180° of the cycle, the piston reaches its lower dead centre and starts its return stroke in the course of which it covers in succession the transfer ports 9b (at about 200°-Fgc), the complementary intake ports 19 (at about 255°-Fgnc) and, lastly, the whole of the exhaust port 13 (at about 270°-Fech). Before again reaching its upper dead centre, corresponding to the last stage in the course of which the compression, the explosion and the production of new burnt gases occur.

It will be clear that the angle values indicated for this cycle are given merely by way of example and preference, it being understood that the sole immportant thing is the order in which the opening and closure of the ports occur, it being however stressed that, in its downward travel, the piston must uncover the transfer ports 9b (permitting the admission of the carburetted gases) late enough to ensure that the carburetted gases cannot reach the exhaust port 13.

In this arrangement, it is the piston 2 which acts as a valve determining the period during which the non-carburetted fresh gases are admitted into the cylinder, the start and the end of this intake period being determined by the position of the upper edge of the ports 19 along the axis X—X.

Note that, by way of a modification, there may be provided on the pipe 17 a rotary valve of the type which will be described hereinafter with reference to FIG. 7 to obtain a period of intake of the carburetted gases which is dissymetrical relative to the bottom dead centre.

Figure 7:
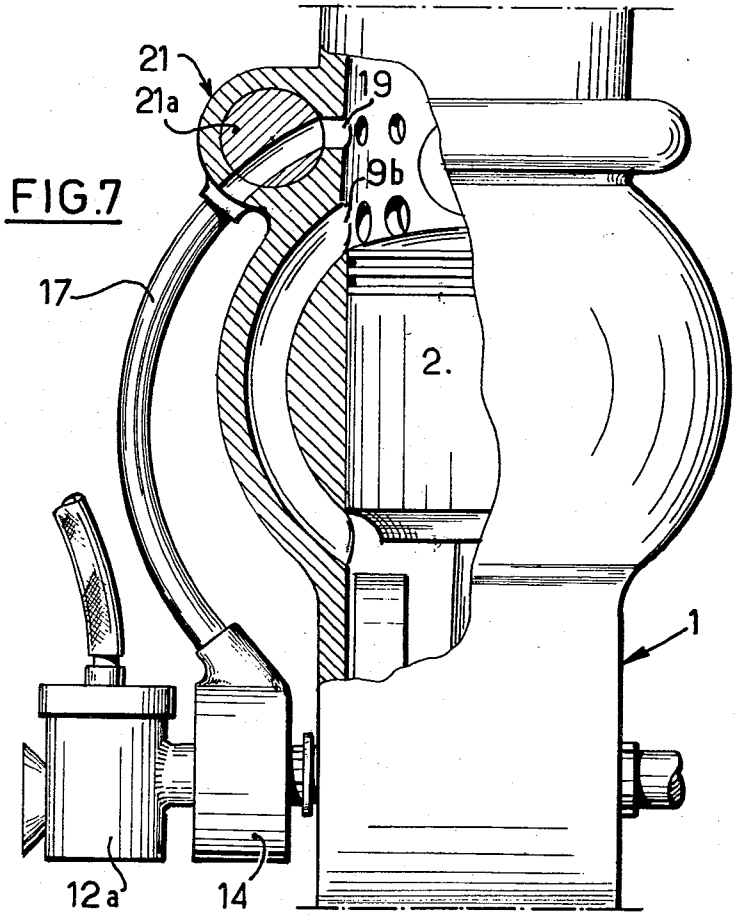
FIG. 7 is a view similar to FIG. 1 of a second embodiment of this invention.

In the second embodiment, illustrated in FIGS. 7 and 8, the motor comprises a structure similar to the embodiment of FIGS. 1 to 6, except for the following modifications:

On the input side of the compressor 14, there is provided not the control means 15 of the first embodiment but the conventional carburetter 12a providing the carburetted gas mixture.

The intake pipe, leading to the intake port 12, is connected not to the conventional carburetter 12a as in the first embodiment but to a control means 15 which permit the introduction of non-carburetted fresh gases and are similar to the means 15 of the first embodiment.

Provided on the pipe 17 is a rotary valve 21 whose valve member has a passage 21a which allows, in a given position of the valve member, the direct communication of this pipe 17 with the supply manifold 18 of the ports 19.

The valve member 21a is connected to actuating means (not shown) which are, for example, mechanical or electronic. These means rotate the valve member in such manner as to conform to the stages described hereinafter with respect to the cycle of operation.

The device according to the second embodiment operates in the following manner:

In the upper dead centre position, the explosion urges the piston downwardly at about 90° of the cycle, the piston starts to uncover the exhaust port 13 so that the burnt gases can start their exhaust.

As it travels downwardly, the piston uncovers the upper ports 19 but the latter are still closed by the rotary valve 21. At about 130°, the piston starts to uncover the lower ports 9b which then allow the admission of non-carburetted fresh gases, i.e. air, this air scavenging the residual burnt gases and lubricating the walls.

Having reached its lower dead centre position, the piston starts its upward stroke and, at about 220° of the cycle, the actuating means for the rotary valve 21 rotate the valve member of the latter so as to permit the admission of the carburetted gases by way of the upper ports 19, these carburetted gases thus admitted into the cavity 11 then expelling a part of the air contained therein by way of the exhaust port 13.

Substantially simultaneously, the rising of the piston closed the air intake ports 9b.

At about 270° of the cycle, the piston completely closes the exhaust ports 13 while, as the rotary valve is still open, the compressed carburetted gases continue to fill the cavity 11 of the cylinder.

At about 300° of the cycle, the actuating means of the rotary valve rotate the valve member of the latter in the closing direction and thus interrupt the admission of the carburetted gases, this closure occurring just before the piston completely closes the upper ports 19 in its upward travel.

The piston then rises to its upper dead centre position.

The actuating means of the rotary valve 21 are adjustable. The adjustment or setting in the preceding description, which corresponds to the use of a motor on a touring vehicle, is such that the opening of the valve i.e. the start of the intake of the carburetted gases, coincides with the closure of the air intake, i.e. with the end of the scavenging stage.

However, the actuating means of the rotary valve are adjusted in the case of a high-performance motor, in such manner that this opening of the valve occurs in about the middle of the scavenging stage, namely approximately in the vicinity of the lower dead centre position shown in dotted lines in the cycle of FIG. 8. Such an adjustment very advantageously doubles the power of the motor.

As concerns the closure of the carburetted gas intake, note that carburetted gases are continued to be introduced after the closure of the exhaust by the piston, which increases the amount of carburetted gases contained in the cylinder and as a result of the explosion, increases the power of the motor.

This is the reason why it is very advantageously arranged that the passage 21b of the valve member of the valve be disposed above the upper edge of the exhaust port 13.

The optimum adjustment is moreover achieved when the passage of the valve member is closed just before the arrival of the piston at its level.

Further, bearing in mind that the carburetted gases admitted expel the scavenging air through the exhaust port, an optimum adjustment or setting is reached when the piston closes the exhaust port 13 at the moment when all the scavenging air has been exhausted, which ensures that no air remains in the explosive mixture.

However, it must be noted that if air remains, it does not concern a loss, since this air participates in the mixture. It consequently concerns a question of adjustment.

On the other hand, this presence of a cushion of air permits avoiding the incompatibility which previously existed in known motors between the obtainment of high-power and an economy of fuel.

Indeed, it must be noted that, on one hand, the sooner the carburetted gases are admitted, the higher the power of the motor and, on the other hand, the later the carburetted gases are compressed, the more economical is the motor. Consequently, it is very easy to obtain a powerful motor at low running speed. It is even possible to open the carburetted gases valve only very late i.e. at a moment when the exhaust port is completely closed. The indicated result is thus obtained even at a running speed of, for example, 200 rpm without any loss of gas.

In a particularly advantageous embodiment, the actuating means of the valve member of the valve are means having a continuous adjustment whether this be mechanical means (for example a mechanical governor mass) or electronic means, such a microprocessor, this adjustment being arranged to allow the motor to furnish full power at all running speeds. The actuating means must be adjusted in such manner as to advance or delay, in the manner of an ignition time setting the opening of the valve in accordance with the running speed, an advance being provided when operating at high running speed and a delay when operating at low running speed.

Further, it should be mentioned that the second embodiment described hereinbefore has the big advantage of affording "permeability of the cylinder" i.e. a total area of the gas passages multiplied by about 1.5 relative to a conventional two-stroke motor which permits delaying at will the admission of the carburetted gases and completely expelling the burnt gases with no fear of loss of fuel through the exhaust. Thus, if the intake delay is 50%, this delay corresponds to the duration of the conventional intake. The delay may be adjusted at will between a low delay value, corresponding to a motor running at high speed, and a high delay value corresponding to a motor running at low speed. The increase in the "permeability" indicated hereinbefore permits an increase in the power and efficiency, it being moreover noted that the cyclic regularity of a two-stroke motor is greatly superior to that of a four-stroke motor.

In the same way as concerns the cycle of the first embodiment, the present cycle described with reference to FIG. 8 is given merely by way of example as concerns the angles, the sole important thing being the order in which the openings and closures succeed one another.

However, note that:

the closure of the intake of the carburetted gases occurs very advantageously after the closure of the exhaust, so that the admission of the carburetted gases continues beyond its closure;

the opening of the intake of the carburetted gases can be arranged indifferently, as a function of the setting and the running speed of the motor, either before, simultaneously with, or after the closure of the intake of the air (or non-carburetted gases).

Note that the case pump of the motor, formed by the lower cavity 10 of the case, continues to perform the intake function, namely the intake of gases in the case of known two-stroke motors, but here also ensures the intake of air or non-carburetted fresh gases and vaporized oil which continues to lubricate the walls of the cylinder.

Moreover, note that, in the second embodiment described hereinbefore in which the carburetted gases are brought above the transfer ports **9*b* of the scavenging air, the valve 21** is absolutely necessary in order to ensure, among other things that there is no further admission of carburetted fresh gases upon the downward travel of the piston.

This second embodiment is particularly advantageous in that it permits achieving a power which is of the order of doubled power.

By way of modification, it is also possible to use two turbines or compressors coupled together, one for introducing non-carburetted gases (or air) and the other carburetted gases.

Figure 9:
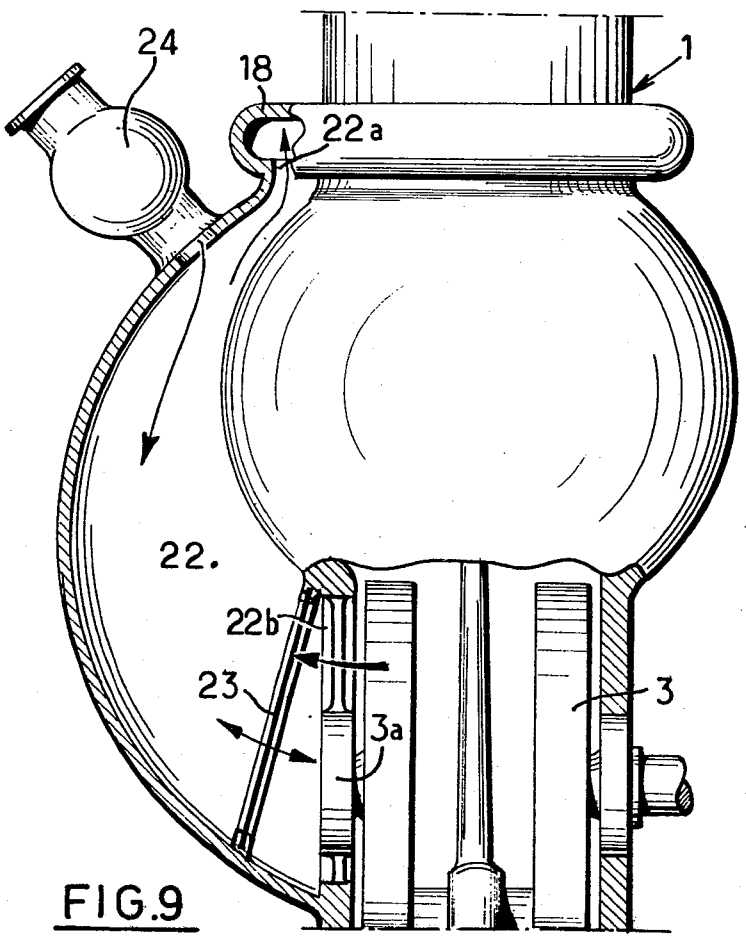
FIG. 9 is a view similar to FIGS. 1 and 7 in respect of a motor according to a third embodiment of the invention.

In the third embodiment illustrated in FIG. 9, the motor has a structure similar to that of the embodiment of FIG. 1 except that the unit for introducing non-carburetted gases or air, formed by the control means 15, the turbine 14 and the pipe 17 is replaced by a transfer passage 22 formed in the wall of the case, outside and on one side of the latter.

This transfer passage 22 has a section which increase at an extremely high rate between its upper end, where it is connected to the manifold 18 of the complementary intake ports 19 by way of an orifice **22*a*, and its lower end, where its section substantially corresponds to an opening 22*b* formed in the wall of the lower case 1*b*. This opening 22*b* however includes support means for the bearing 4. A flexible membrane or diaphragme 23 is inserted in this transfer passage in facing relation to the opening 22*b* and slightly spaces away from the latter. This membrane 23 thus partitions off a volume communicating with lower cavity 10 of the case from the volume of the transfer passage 22. The latter is completed by an intake valve for the carburetted gases or air, this valve 24 being, for example, of the lamella or blade type and disposed in such manner as to open onto the passage 22** in the vicinity of the upper end of the latter.

The device just described operates in the following manner:

when the piston rises and the volume of the lower cavity 10 increases, carburetted fresh gases are drawn in through the valve 24 and fill the volume of the transfer passage 22, the membrane 23 bending or deforming towards the cavity 10 of the case.

Thereafter, when the piston descends, the compression of the carburetted gases contained in the cavity 10 below the piston inflate the membrane 23 in the opposite direction towards the volume of the transfer passage 22, the air or non carburetted gases contained in this volume travel through the orifice **22*a* to inside the upper cavity 11 by way of the intake ports 19**.

This arrangement is particularly simple and cheap and relatively advantageous in the manufacture of small-size motors.

It must be understood that various modifications may be made in the embodiments just described, without departing from the scope of the invention. Thus, in particular, there may be provided two or more pipes 17 connecting the output side of the compressor 14 to the distributing manifold or ring 18. The latter may be replaced by two or more ring sectors.

We claim:

1. A two-stroke motor comprising a case defining a generally cylindrical upper cavity and a lower cavity, a piston slidably mounted in said upper cavity, a crankshaft disposed in said lower cavity, means connecting said crankshaft to said piston, carburetted gas supply means for supplying carburetted gas, non-carburetted gas supply means for supplying non-carburetted gas, at least one of said gas supply means including said lower cavity, and transfer conduit means for transferring gas from said lower cavity to said upper cavity, said lower cavity providing crankcase compressor means for compressing the gas supplied, said upper cavity presenting an exhaust port by which burnt gas is exhausted, said exhaust port having an upper edge, a first set of intake ports spaced apart angularly around said upper cavity and through which said non-carburetted gas supply means communicates with said upper cavity and a second set of intake ports spaced apart angularly around said upper cavity and through which said carburetted gas supply means communicates with said upper cavity, the intake ports of said first set presenting upper edges disposed below said upper edge of said exhaust port, and one of said sets of intake ports being disposed above the other set, said gas supply means being arranged to commence supplying non-carburetted gas to scavenge said upper cavity after said exhaust port is uncovered by said piston and before supplying carburetted gas to said upper cavity.

2. A motor as claimed in claim 1 wherein the number of intake ports in said first set is substantially equal to the number of intake ports in said second set.

3. A motor as claimed in claim 1 wherein said transfer conduit means connects the lower one of said first and second sets of intake ports to said lower cavity.

4. A motor as claimed in claim 3 wherein said non-carburetted gas supply means includes said crankcase compressor means, said carburetted gas supply means being connected to the upper set of intake ports and including valve means for enabling the supply of carburetted gas to said upper cavity at a controlled time after said intake ports are uncovered by said piston.

5. A motor as claimed in claim 4 wherein said carburetted gas supply means includes control means responsive to the speed of the motor for continuously controlling the opening time of said valve means, whereby to advance and retard the opening time at relatively high and low engine speeds respectively.

6. A motor as claimed in claim 3 wherein said carburetted gas supply means includes said crankcase compressor means, said non-carburetted gas supply means being connected to the upper set of intake ports.

7. A motor as claimed in claim 3 wherein that one of said gas supply means which is connected to the upper set of intake ports includes further compressor means.

8. A motor as claimed in claim 7 wherein said carburetted gas supply means includes said crankcase compressor means and said non-carburetted gas supply means includes said further compressor means, the motor including gas control means for controlling the supply of carburetted gas and for controlling the intake of non-carburetted gas to said further compressor means.

9. A motor as claimed in claim 7 wherein said non-carburetted gas supply means includes said crankcase compressor means and said carburetted gas supply means includes said further compressor means and carburettor means connected to supply carburetted gas thereto.

10. A motor as claimed in claim 1 wherein said crankcase compressor means included in one of said gas supply means is also coupled to the other of said gas supply means which includes further transfer conduit means coupled with said crankcase compressor means for supplying compressed gas to said upper cavity and membrane means separating said further conduit means from said lower cavity.

11. A motor as claimed in claim 1 wherein said non-carburetted gas supply means includes a source of vaporized lubricating oil.

* * * * *